United States Patent [19]

Blomseth

[11] 4,248,132

[45] Feb. 3, 1981

[54] BULLET SEATING DEPTH GAUGE

[76] Inventor: Harold K. Blomseth, 69016 McMullin Dr., Bend, Oreg. 97701

[21] Appl. No.: 91,349

[22] Filed: Nov. 5, 1979

[51] Int. Cl.[3] ..... F42B 35/02

[52] U.S. Cl. ..... 86/24; 33/168 R; 86/43

[58] Field of Search ..... 86/24, 43; 33/168 R

[56] References Cited

U.S. PATENT DOCUMENTS

| | | | |
|---|---|---|---|
| 2,668,360 | 2/1954 | Keller | 33/168 R |
| 2,700,915 | 2/1955 | Pattison | 86/43 |
| 2,741,148 | 4/1956 | Thompson, Jr. | 86/24 X |
| 3,580,127 | 5/1971 | Lee | 86/24 |
| 3,736,835 | 6/1973 | Hanson | 86/43 X |

*Primary Examiner*—Leland A. Sebastian
*Attorney, Agent, or Firm*—Wells, St. John & Roberts

[57] ABSTRACT

A depth gauge for measurement of effective loaded cartridge length in relation to the dimensions along the chamber of the rifle or other firearm. The gauge comprises a caliber cap having an aperture corresponding in transverse dimension to the land diameter of the rifle barrel. A guiding body is longitudinally adjustable on the caliber cap and includes inside surfaces complementary to the cartridge diameter. A loaded cartridge is aligned within the body and caliber cap with its bullet nose resting within the aperture. The outer end of the body serves as a length reference by which comparisons can be made between the effective cartridge length and the rifle chamber dimensions.

18 Claims, 12 Drawing Figures

BULLET SEATING DEPTH GAUGE

BACKGROUND OF THE INVENTION

This invention relates to a device for facilitating measurement of loaded cartridge lengths in relation to the longitudinal chamber of a rifle or similar firearm. It is designed specifically for use in presetting reloading equipment prior to accurate seating of bullets in a cartridge case.

Every rifle and firearm has slightly different longitudinal dimensions along the chamber between the bolt face and the leading edge of the rifling lands. It is important to a reloader to seat each bullet accurately and to assure consistent bullet clearance in the chamber. Because the shapes of bullets differ, it is presently necessary to determine the seating depth of each form of bullet for each rifle or firearm by tedious trial and error methods which must be constantly repeated.

This disclosure relates to a guage that serves as a replica in length of the rifle chamber. Once the guage has been adjusted to match the chamber length of a particular rifle, it can be used to guage the length of any bullet being loaded for use with that rifle. The tedious trial and error methods for matching effective loaded cartridge length to the rifle chamber need be carried out only once during initial set-up of the guage.

The guage basically comprises a caliber cap and a telescopically connected body. The cap has an aperture formed within it, including an edge matching the land diameter of the rifle. The coaxial body is movably adjustable with respect to the caliber cap along their common axis. It has inside surfaces capable of aligning a loaded cartridge case and bullet along the aperture axis. Once the body and caliber cap have been axially positioned to match the longitudinal dimension of a particular rifle chamber, any bullet can be placed within the guage to compare its effective length against the chamber dimension.

DESCRIPTION OF A PREFERRED EMBODIMENT

This disclosure relates to length measurements involved in the reloading of cartridge cases for use in rifles and similar firearms. Reloaded cartridge cases are typically used for target shooting, where accuracy and consistency is highly valued. A reloader must achieve accurate matching between the length of each reloaded cartridge case and bullet and the rifle chamber dimensions to assure consistent and accurate results when the bullets are fired. The present guage makes it exceptionally easy to customize the length of a particular reloaded cartridge case and bullet combination to match the requirements of a specific rifle. It assures consistent longitudinal clearance between the bullet and the rifling lands of the barrel, regardless of the specific nose configuration of a particular bullet.

Figure 4:
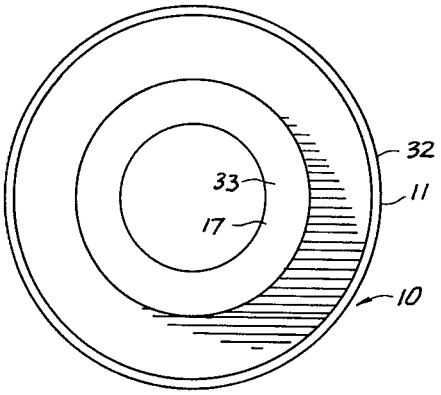
FIG. 4 is a left hand end view of FIG. 3.
Figure 5:
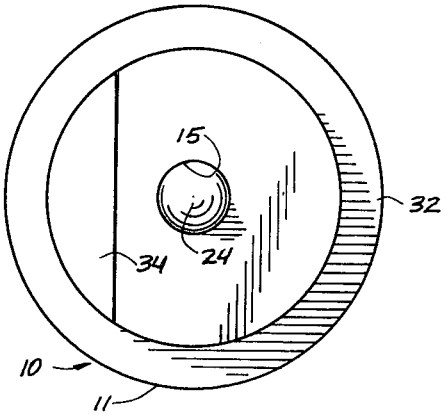
FIG. 5 is a right hand end view of FIG. 3.
Figure 6:
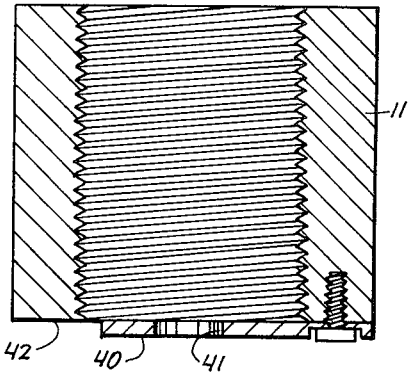
FIG. 6 is a sectional view showing a modified caliber cap.
Figure 7:
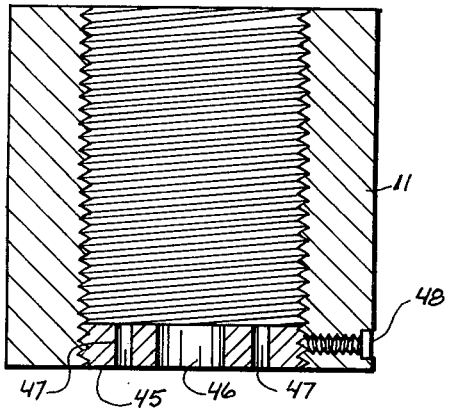
FIG. 7 is similar to FIG. 6, showing a second modification.
Figure 8:
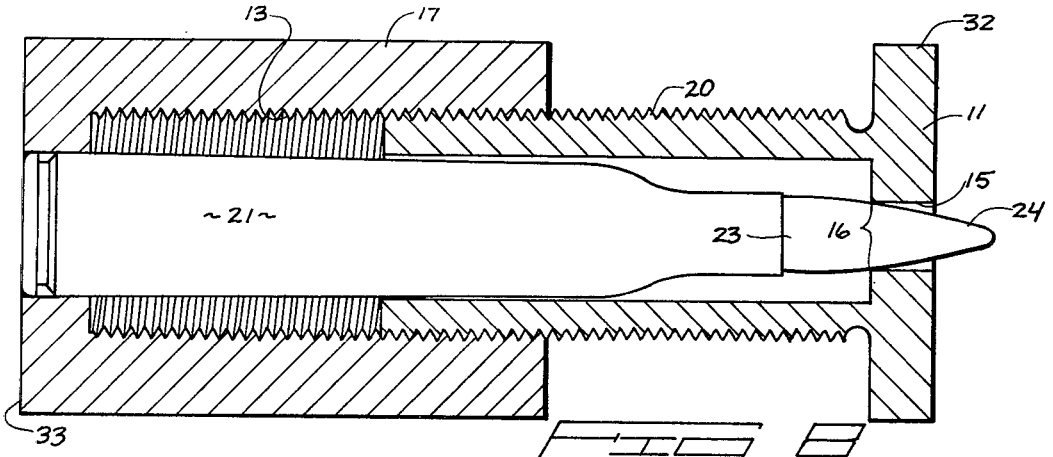
FIG. 8 is a longitudinal sectional view of a second embodiment.
Figure 9:
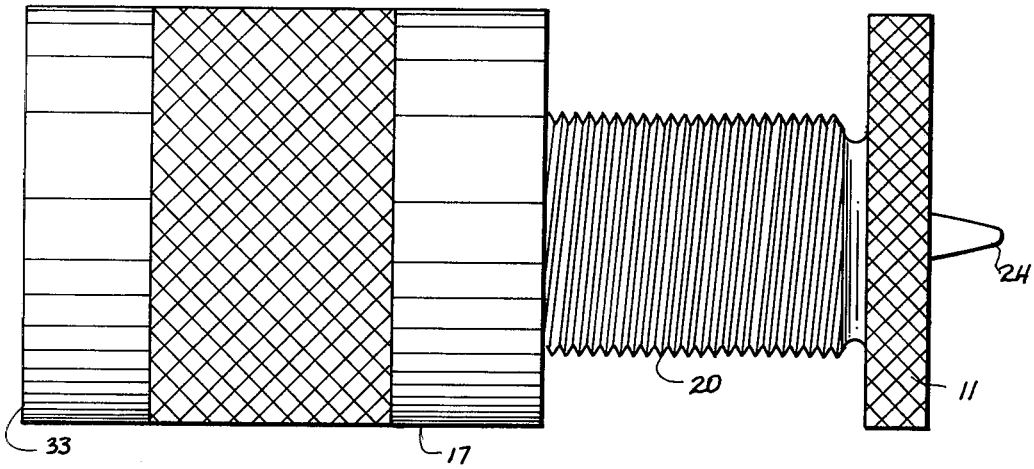
FIG. 9 is a side elevation of the second embodiment.
Figure 12:
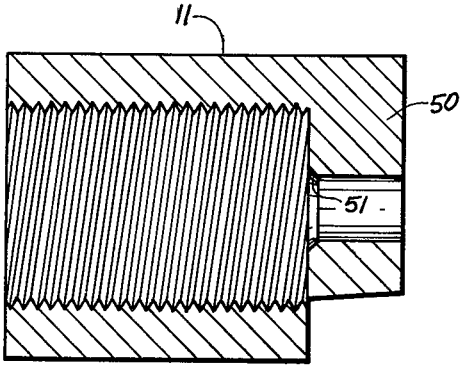
FIG. 12 is a view similar to FIG. 6, showing another modification of the caliber cap structure.

The guage itself is shown in two embodiments. The first, shown in FIGS. 3 through 5, utilizes an external caliber cap and an internal adjustable body that longitudinally aligns the cartridge case. The second, shown in FIGS. 8 through 11, shows a model where the caliber cap extends within the body. Other variations in this structure relating to the caliber plate are shown in FIGS. 6, 7 and 12.

Figure 1:
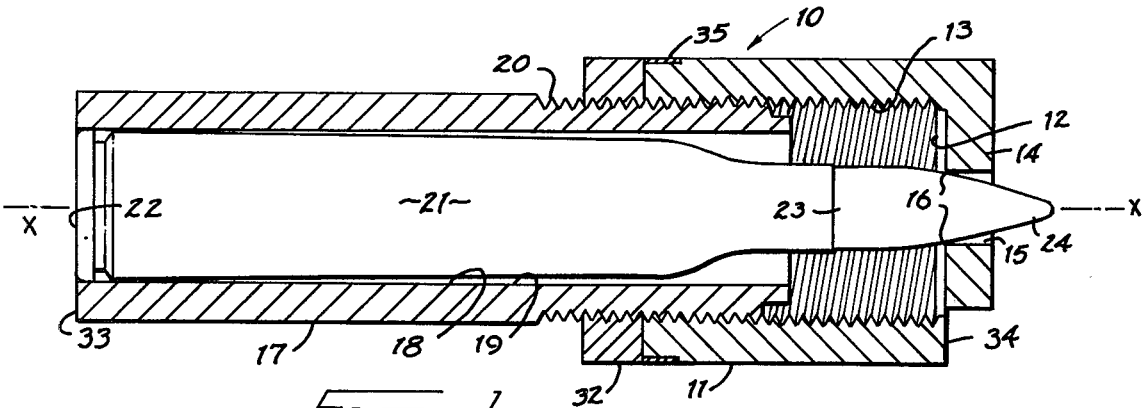
FIG. 1 is a diagrammatic longitudinal sectional view through the present invention.
Figure 2:
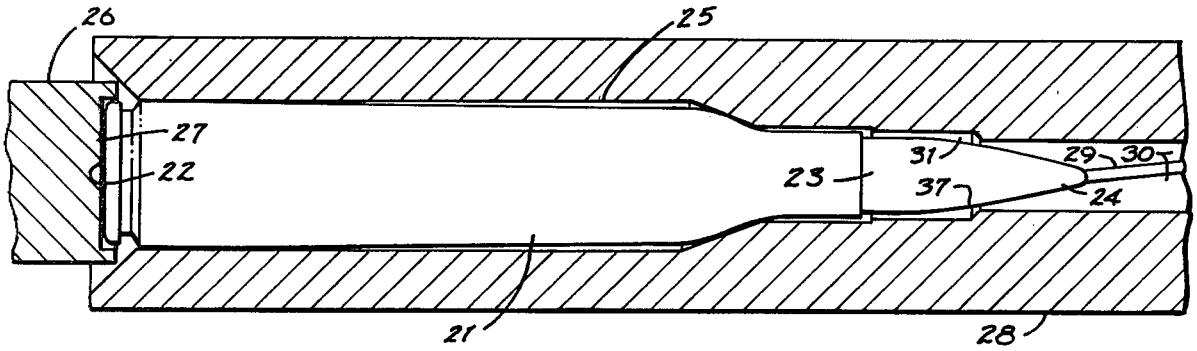
FIG. 2 is a diagrammatic longitudinal sectional view through a loaded rifle chamber.

FIGS. 1 and 2 show sectional views taken through the present guage 10 and through a typical chamber 25 in a rifle or similar firearm. These drawings show a loaded cartridge case 21 and bullet 23 within the firing chamber 25 and within the guage 10.

To understand the use of guage 10, it is essential to understand the size relationships between the loaded cartridge case and bullet and the chamber 25 of the rifle within which it is to be fixed. This relationship is illustrated in FIG. 2. The rear end 22 of the loaded cartridge case is abutted by the bolt face 27 of the firing bolt 26. The nose 24 of bullet 23 projects forwardly to a location slightly beyond the leading edge 37 of the rifling lands 29. The rifle barrel 28 is provided with the usual lands 29 and grooves 30 that extend forwardly from this leading edge 37. A throat 31 provides a transition between the enlarged diameter within chamber 25 and the reduced diameter of lands 29.

When reloading cartridge cases for a particular rifle or firearm, it is essential that the bullets 23 be accurately seated to provide completed assemblies having consistent length and a controlled clearance between the bullet and the leading edge of the lands. Effective length of the loaded cartridge case and bullet cannot be measured from the outer end 22 of the cartridge case 21 to the tip of the bullet nose 24. While this length could be readily measured and monitored, the total necessary length for proper fit will vary from one bullet configuration to another. The nose of some bullets are more elongated and slim, while others are more rounded or blunt. Since the outer tip of the bullet nose 24 projects beyond the leading edge 37 of the lands 29, the total length of the loaded cartridge case and bullet is not directly proportional to the seated depth of the bullet to assure proper clearance between the bullet and the lands.

Several methods are currently used by hand loaders to calibrate their manual equipment for seating bullets within cartridge cases by use of a seating die. These methods typically involve an elaborate series of trial and error measurements for each form and size of bullet.

For instance, one method involves the insertion of a bullet into the chamber to contact the throat rifling and insertion of a ramrod from the barrel muzzle until it just touches the bullet point. The ram rod is then marked to indicate the distance from the muzzle to the bullet point. With the chamber empty and the bolt closed, the ram rod is moved inwardly against the bolt face and again marked at the muzzle. The two marks are then used as an indication of the maximum overall cartridge length which would allow the particular bullet to just contact the lands. A dummy round is then assembled to this length and placed within the chamer. If rifling marks appear on the bullet after being chambered, it is seated deeper into the case in small progressions until no marks are present. This dimension is then used as a reference length for experimentally determining the best overall cartridge length and clearance for that one bullet and rifle combination.

Another method used to determine chamber length for a bullet is to coat the surface of the bullet in a dummy cartridge and insert it within the rifle chamber in a succession of attempts. The bullet seating depth is increased progressively until the rifle bolt closes and the marks of the rifling lands are just faintly visible on the coated bullet surfaces.

These trial and error procedures must be repeated each time a bullet of different size and shape is to be used in the reloading process, because the overall length of each assembled bullet and cartridge case combination must be a different length in order to provide proper land contact.

Referring to FIGS. 1 and 3 through 5, the guage 10 includes a caliber cap 11, shown as an open ended cylindrical member having knurled outer surfaces to assist in turning cap 11 relative to a complementary aligning body 17. Cap 11 includes a threaded recess 12. A transverse wall 14 across the end of cap 11 is planar and contains a cylindrical aperture 15 having a diameter equal to the land diameter within the rifle barrel and centered about an axis X—X (FIG.1). The intersection of aperture 15 and the inside surface of transverse wall 14 provides an inner edge 16 which corresponds to the leading edge 37 of the lands in the rifle barrel.

The caliber cap 11 threadably engages the outer surface of aligning body 17 to permit longitudinal adjustment between cap 11 and body 17 by relative rotation of their threaded surfaces at 13 and 20, respectively. Recess 18 within body 17 is cylindrical and coaxial with axis X—X. It is generally complementary to the shape of the cartridge case 21, with reasonable radial clearance being provided. The outer end surface 33 formed perpendicularly across body 17 serves as a transverse reference for visual inspection or physical measurement of the effective guage length.

With the structure shown in FIGS. 1 and 3–5, the effective length of the assembled bullet and cartridge case can be immediately determined by visual inspection and external measurement. The caliber cap 11 and aligning body 17 are axially adjustable relative to one another so that one can accurately preset the longitudinal distance between the transverse outer surface 33 across the outer end of body 17 and the plane of a reference edge 16 within an aperture 15 at the outer end of caliber cap 11.

In using gauge 10, it is necessary first to determine the chamber length of the rifle by the conventional trial and error method. This is done preferably by coating the surface of a bullet within an empty cartridge case and seating it within the chamber with the bolt closed until the marks of the rifling lands are just visible on the bullet surfaces. This cartridge and bullet is then placed within the gauge 10 with the bullet nose extending partially into the aperture 15 on wall 14 and resting on edge 16. The inner surfaces of cylindrical wall 19 within body 17 accurately align the cartridge case 21 and bullet 23 coaxial with the axis X—X. Caliber cap 11 and body 17 can then be rotated relative to one another about axis X—X to adjust their longitudinal positions and bring surface 33 flush with the outer end 22 of cartridge case 21. With the caliber cap 11 and body 17 of gauge 10 locked in this spatial position, any shape of bullet being reloaded can be checked against the chamber length of the particular rifle through the intermediary of the gauge. Stops on the reloading press can therefore be accurately set by the user, who can measure the effective seated length of the cartridge case and any bullet by simply inserting the loaded cartridge into gauge 10. If the outer end 22 of the cartridge case 21 is flush with the surface 33, the clearance in the firing chamber between the bullet surfaces and the rifle lands will be identical for all bullets, regardless of the bullet nose shape or type.

Caliber cap 11 is completed in this embodiment by a cylindrical lock nut 32 threadably mounted about body 17 in engagement with the male threads 20. It is adapted to be selectively tightened against the inner end of caliber cap 11 to thereby lock the relative positions of the cap 11 and body 17 with respect to one another.

The wall 14 across the outer end of caliber cap 11 is preferably interrupted across a portion of its width to expose a transverse outer surface 34, which lies in a plane perpendicular to axis X—X and parallel to the outer surface 33 on body 17. The surface 34 is coincident with a transverse plane containing the edge 16 about aperture 15. It permits external measurement of the effective length of gauge 10 by outside calipers. By recording the effective gauge length for a particular bullet, one can reset gauge 10 when subsequently reloading bullets for a particular rifle. When clearance is desired between the bullet and rifling lands, the effective length of gauge 10 must be shortened from this recorded measurement. The amount of adjustment required for particular clearance specifications can again be readily measured by use of outside calipers. This length can also be recorded for future reference.

Figure 3:
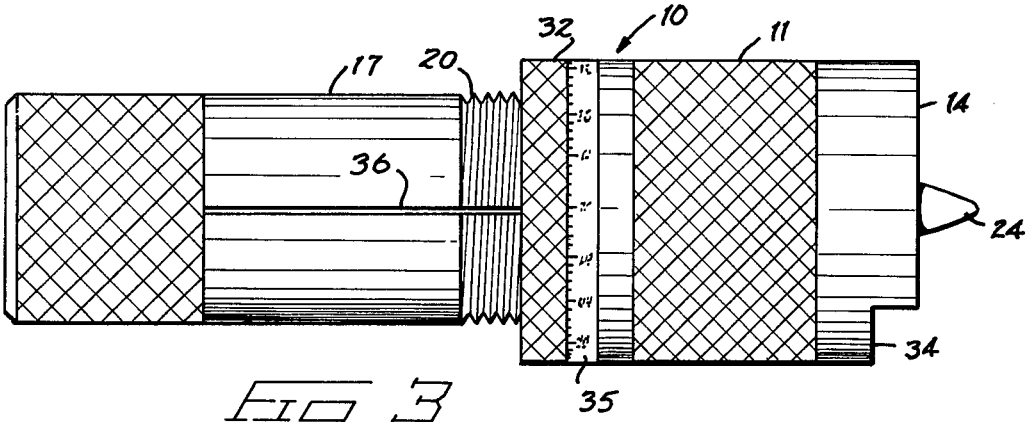
FIG. 3 is a side elevation view of a first embodiment of the invention.

When desired, a calibration ring 35 is frictionally mounted on caliber cap 11, as shown in FIG. 3. The calibration ring 35 is provided with peripheral indicia which are related to an axial line 36 provided along body 17. As an example, line 36 could be provided as an axial score or sawn groove.

Ring 35 facilitates adjustment between caliber cap 11 and body 17 to provide accurate bullet "lede" or clearance. By setting the caliber cap 11 and body 17 to an effective length corresponding to zero clearance between the bullet surfaces and the rifling lands, one can then set the calibration ring 35 to a "zero" setting. Subsequent turning of the caliber and cap 11 relative to body 17 can be visually measured by the indicia on ring 35 in relation to the axial line 36. Direct measurement of this axial adjustment can be provided by proper choice of threads and angular spacing of the indicia on ring 35, similar to measurements accomplished on a micrometer. The details of such visual measurements will be obvious to those skilled in the design of such tools.

The embodiment of the invention illustrated in FIGS. 8 through 12 is functionally the same as that described above. The same reference numerals have been applied to the corresponding elements included in this embodiment and no further specific description of their interrelationship and use is believed necessary. In this embodiment, male threads 20 are provided on the caliber cap 11 and complementary female threads 13 are provided on the body 17.

Figure 10:
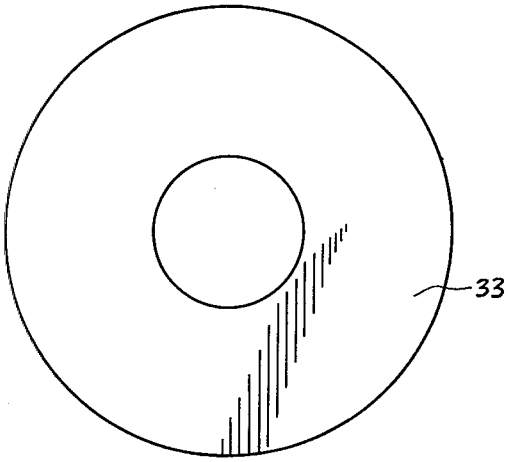
FIG. 10 is a left hand end view of FIG. 9.
Figure 11:
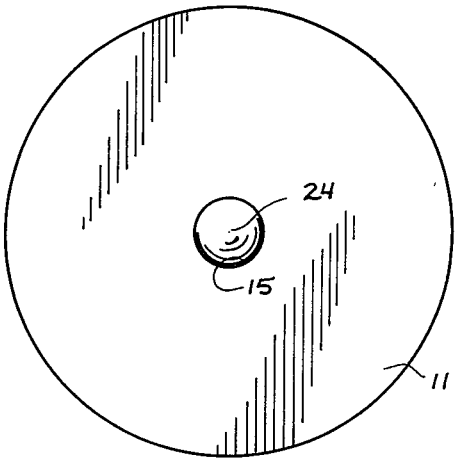
FIG. 11 is a right hand end view of FIG. 9.

Minor variations of the structure are shown in FIGS. 6, 7 and 12. FIG. 10 shows a modified caliber cap 11 having a replaceable wall or caliber plate 40 across its outer end. The plate 40 includes a cylindrical aperture 41 and is bolted to an outer surface 42 of the caliber cap 11. Surface 42 lies in a plane perpendicular to the axis of the gauge 10. The caliber plate 40 is interchangeable with similar caliber plates (not shown) having different size apertures 41 corresponding to different caliber sizes for rifles or firearms with which the gauge 10 is to be used. An arcuate section of the caliber plate 40 is cut away to expose a portion of the surface 42 (shown to the left in FIG. 7). As described previously, this exposed surface serves as an external measuring reference for physically determining a separation between the inner plane across caliber plate 40 and the outer surface 33 at the far end of the body 17.

Similarly, FIG. 7 shows a removable or interchangeable caliber plate 45 threadably engaged within the caliber cap 11. Plate 45 includes an aperture 46 of a chosen size corresponding to a particular rifle or firearm. The caliber plate 45 includes a pair of diametrically opposed apertures 47 to receive the prongs of pliers or a spanner wrench (not shown) to assist in removal or assembly of the caliber plate 45 within the cap 11. If desired, plate 45 can be selectively fixed within the caliber cap 11 by a radial set screw 48.

To provide even greater accuracy in gauging effective bullet length, FIG. 12 shows a modification of the caliber cap 11 having a thickened cross section through a modified outer wall or caliber plate 50. At the center of this thickened wall 50 is a tapered aperture 51. The aperture 51 is machined so as to match the taper of the lands adjacent to the throat 31 of the rifle or firearm with which it is to be used. The throats 31 of rifles produced by each manufacturer are machined by use of throat reamers. Reamers of the same profile can be used to machine the inside surfaces of the tapered aperture 51. In this way, the gauge 10 will have inside surfaces exactly identical to the inner surfaces engaged by a bullet within the chamber 25. While the cylindrical apertures previously discussed have been found to be very suitable for gauging the depth of bullet seating, this further refinement by providing a matching taper within aperture 51 assures further accuracy and even better adapts the gauge 10 to match the rifle chamber requirements to all bullet nose configurations.

Other changes can obviously be made in the gauge structure by substituting differing means for longitudinal adjustment between the caliber cap 11 and body 17, alternate locking means, such as a set screw, or by constructing either the caliber cap 11 or body 17 of one or more interfitting parts to provide the required interconnections between them and interior guiding surfaces for the cartridge case 21 and bullet 23. Such variations would not modify the basic structure nor the function of the gauge as previously described.

I claim:

1. A gauge for comparing the assembled length of a loaded cartridge case and bullet between the outer end of the cartridge case and an intermediate position on the bullet nose in relation to the longitudinal chamber length of a rifle between its bolt face and the leading edges of the lands in its barrel, comprising:

a member having a recess formed about a longitudinal axis;

a transverse wall on said member across one end of said recess, said wall having an opening therein centered about said axis and presenting an arcuate edge to said recess in a first plane perpendicular to said axis, said edge having a diameter that is equal to the land diameter of the rifle and is centered on said axis;

a transverse reference on said member at its remaining end, said reference being located in a second plane that is parallel to and axially spaced from said first plane; and guide means on said member located within the recess intermediate said planes for aligning a loaded cartridge case and bullet coaxially along said longitudinal axis with the bullet nose extended into said opening and resting against said arcuate edge;

whereby a comparison can be made between the resulting longitudinal location of the outer end of the cartridge case and the transverse reference on said member.

2. A gauge as set out in claim 1 wherein the axial spacing between said first and second planes is equal to the longitudinal chamber length of the rifle between its bolt face and the leading edges of the lands in its barrel.

3. A gauge as set out in claim 1 wherein the axial spacing between said first and second planes is equal to the longitudinal chamber length of the rifle between its bolt face and the leading edge of the lands in its barrel, less a predetermined amount of clearance.

4. A gauge as set out in claim 1 wherein said member comprises first and second elements joined for selective movement relative to one another along such axis;

said first element including said transverse wall and opening;

said second element including said transverse reference.

5. A gauge as set out in claim 1 wherein said member comprises first and second elements joined for selective movement relative to one another along said axis;

said first element including said transverse wall and opening;

said second element including said transverse reference; and means operatively connected to said first and second elements for selectively fixing their positions relative to each other.

6. A gauge for comparing the assembled length of a loaded cartridge case and bullet between the outer end of the cartridge case and an intermediate position on the bullet nose in relation to the longitudinal chamber length of a rifle between its bolt face and the leading edges of the lands in its barrel, comprising:

a first element having a recess formed therein centered about a longitudinal axis, said first member having a transverse wall across one end of the recess;

an opening formed through said transverse wall and presenting a circular edge to said recess in a plane perpendicular to said axis, said edge being centered about said axis and having a diameter equal to the land diameter of the rifle barrel;

a second element having a recess formed therein including an inner cylindrical wall centered about a longitudinal axis, the wall having a diameter complementary to the outer diameter of a cartridge case;

a transverse surface formed across one end of said second element and intersecting said recess in a plane perpendicular to the longitudinal axis of the second element; and adjustment means on said first and second elements for assembling their respective remaining ends in a coaxial telescoping relationship.

7. A gauge as set out in claim 6 wherein said adjustment means comprises complementary male and female threads formed at the respective remaining ends of said first and second elements.

8. A gauge as set out in claim 6 further comprising:

locking means operatively connected between said first and second elements for selectively fixing their respective axial positions relative to one another.

9. A gauge as set out in claim 6 further comprising:

a transverse surface formed across said one end of the first element in a plane perpendicular to its longitudinal axis and coincident with the plane containing the circular edge within said opening.

10. A gauge as set out in claim 6 wherein said adjustment means comprises complementary male and female threads formed at the respective remaining ends of said first and second elements;

axial visual reference located on the threaded portion of one of the elements; and a cylindrical visual reference on the remaining one of said elements, whereby the relative position of the elements is directly proportional to the relative positions of said references.

11. A gauge for comparing the assembled length of a loaded cartridge case and bullet between the outer end of the cartridge case and an intermediate position on the bullet nose in relation to the longitudinal chamber length of a rifle between its bolt face and the tapered throat terminating at the leading edges of the lands in its barrel, comprising:

a caliber cap having a recess formed therein centered about a longitudinal axis;

a transverse wall fixed across one longitudinal end of the caliber cap and having an inner edge intersecting its recess, said wall having an aperture formed therethrough centered along said axis and presenting a circular edge to said recess in a plane perpendicular to said axis, said annular edge being centered on said axis and having a diameter that is equal to the land diameter of the rifle barrel;

a complementary body having a recess therein including an inner cylindrical wall open to one end thereof and centered about a longitudinal axis, said cylindrical wall having a diameter complementary to the outer diameter of a cartridge case;

a transverse planar surface formed across said one end of the body in a plane perpendicular to the longitudinal axis of the body; and complementary threaded means formed about the remaining ends of the body and caliber cap for movably interconnecting the caliber cap and body in an adjustable coaxial relationship.

12. A gauge as set out in claim 11 further comprising:

selectively actuated locking means operably connected between said caliber cap and said body for fixing their axial positions relative to one another.

13. A gauge as set out in claim 11 further comprising:

selectively actuated locking means operably connected between said caliber cap and said body for fixing their axial positions relative to one another; and visual calibrations on said caliber cap and body indicative of their relative axial positions.

14. A gauge as set out in claim 11 wherein the aperture formed through the transverse wall is cylindrical.

15. A gauge as set out in claim 11 wherein the aperture formed through the transverse wall has a varying radius centered along the axis of the caliber cap that decreases from a first edge adjacent the recess to a second edge outward therefrom to match the surface shape, size and configuration at the tapered lands adjacent to the throat of the rifle chamber.

16. A gauge as set out in claim 11 wherein said transverse wall is integral with the caliber cap.

17. A gauge as set out in claim 11 wherein the transverse wall is separable from the caliber cap.

18. A gauge as set out in claim 11 wherein the caliber cap has an outwardly facing planar surface thereon perpendicular to its axis and coincident with a plane containing the inner edge of said aperture.

* * * * *